United States Patent [19]

Marthaler et al.

[11] Patent Number: 4,624,480

[45] Date of Patent: Nov. 25, 1986

[54] MAGAZINE AND DIRECTORY COVER AND HOLDER ASSEMBLY

[76] Inventors: Gregory A. Marthaler, 1969 Dorset Dr., Wheaton, Ill. 60187; Robert H. Marthaler, 942 Sycamore La., Bartlett, Ill. 60103

[21] Appl. No.: 817,683

[22] Filed: Jan. 10, 1986

[51] Int. Cl.[4] ..... B42D 17/00; B42F 13/20

[52] U.S. Cl. ..... 281/49; 281/45; 281/47; 402/80 P

[58] Field of Search ..... 281/45, 46, 47, 48, 281/49, 50; 403/119; 164/381; 402/80 P, 501; 16/221; 40/379, 394, 398

[56] References Cited

U.S. PATENT DOCUMENTS

| | | | |
|---|---|---|---|
| 1,530,130 | 3/1925 | Lloyd | 281/47 |
| 1,552,668 | 9/1925 | Battle | 281/49 |
| 1,683,238 | 9/1928 | Cardoza | 281/47 |
| 1,877,831 | 9/1932 | Franz, Jr. | 281/47 |
| 2,157,080 | 5/1939 | Mandel | 281/47 |
| 4,248,462 | 2/1981 | Choi | 402/80 P |

*Primary Examiner*—Paul A. Bell
*Assistant Examiner*—Paul M. Heyrana, Sr.

[57] ABSTRACT

A binder for holding magazines, catalogs and directories in a protective cover, consisting of a simple, one-piece plastic molding.

11 Claims, 14 Drawing Figures

3
3
10

11
12
18
14
15
19
10

12
11
16
18
10
15

15
21
14
20
16

27
15
10
25
18
24
16
14

MAGAZINE AND DIRECTORY COVER AND HOLDER ASSEMBLY

BACKGROUND OF THE INVENTION

Sheet metal looseleaf binders, or holders, have been known for many years to attach catalogs, magazines and directories to specially designed protective covers that are not provided by the original publisher. Such covers and binders are frequently utilized for public or office telephone directories, magazines on airplanes and waiting rooms, and a myriad of other applications.

These metal binders include an elongated base strip with upturned ends, one of which serves as the pivotal connection for a blade-like binder and the other releasably holds the free end of the binder in position. The base as well as the blade are sheet metal stampings and while relatively inexpensive nevertheless require separate stamping operations and an assembly step to connect the blade to the upstanding end portions of the base strip.

One popular design has a slightly skewed slot in one end into which an "L" shaped leg on one end of the blade is inserted, and this defines the pivotal connection between the blade and the leg. This provides a very poor and sloppy pivotal connection that permits the blade when not attached to the other end of the base to flop around in almost any direction, and in fact easily fall out of the skewed slot.

The other upturned end of the base locks the free end of the blade in position, and it has a first entry slot skewed in a direction opposite the slot in the other end so that the blade must be twisted with a considerable degree of effort to slide it down into this entry slot. A locking slot is connected to the entry slot and after passing through the entry slot, the blade snaps into the locking slot.

In another design the blade is held into a closed locking slot with a key-ring type removable loop that passes through an aperture in the free end of the blade, preventing it from sliding out of the locking slot. This design, of course, requires three separate parts instead of the two in the first design described above.

A third metal binder design utilizes a wire-type blade with a spring-biased locking boss on its free end that must be pulled axially outwardly as the wire passes through an entry slot in one of the upstanding base ends, and then is released into a circular locking hole communicating with the entry slot. This design requires the manufacture and assembly of five separate parts, i.e. the base, the wire blade, the axially slidable boss, the spring for biasing the boss, and a fifth part—a washer that serves as spring seat for the biasing spring.

While all of these metal stamping binders are not expensive to manufacture, in large quantities a minor cost saving can be significant and if it were possible to reduce the manufacturing steps or assembly steps in these binders, it would provide significant savings.

All of these metal binders have no means to position the blade when the blade is not connected to the base at both ends, and this makes it more difficult for the installer of the cover to readily attach the magazine or directory in the binder. Another disadvantage is that the metal stampings have somewhat sharp edges, such as on the sides of the blades, the corners of the upstanding base ends and the edges of the entry slot, and create a risk of scratching or cutting the skin of the individual installing the directory into the cover, and also a risk to people reading the directories or catalogs.

It is a primary object of the present invention to ameliorate the problems noted above in metal cover binders.

SUMMARY OF THE PRESENT INVENTION

In accordance with the present invention, a binder is provided for holding magazines, catalogs and directories in a plastic protective cover, constructed entirely of a durable plastic from a single molding. The binder includes a base with upstanding brackets at each end thereof, and it has an elongated flat blade pivotally connected to one of the brackets with a long-life integral hinge.

The hinge includes a flat rigid portion connected to the blade that overlaps and intersects at 90 degrees a flat flexible portion connected to the bracket. This intersecting and orthogonal relationship between the hinge parts provides increased strength for the flexible portion of the hinge that might otherwise fatigue under cycling stresses.

All of the edges of this binder have uniform radii, eliminating the skin scratching and cutting problem found in many sheet metal binders.

The bracket opposite the hinge bracket on the base has a first entry slot that connects with a locking slot to enable the blade to be slightly twisted and passed through the entry slot into the locking slot, whereby the free end of the blade is held in position and locking is achieved without the effort required in sheet metal binding devices.

The blade is molded at an angle of approximately 20 degrees with respect to the base and this provides the blade with a "memory" tending to urge it to that position. This assists blade locking because it tends to hold the blade in the locking slot in the bracket and it also positions the blade conveniently when open for insertion of the magazine or directory during assembly to the protective cover. This is in contrast to the metal binder assemblies where the blades when not connected to the base simply flop around and in some cases completely fall away from the base.

With Applicants' binder the two-piece manufacturing and assembly are completely eliminated, and its far lighter weight reduces shipping costs. Because bending does not damage Applicants' binder, damage during handling and shipment is greatly reduced.

DETAILED DESCRIPTION OF THE PREFERRED EMBODIMENT

Figures 1, 2, 3, 4, 5:
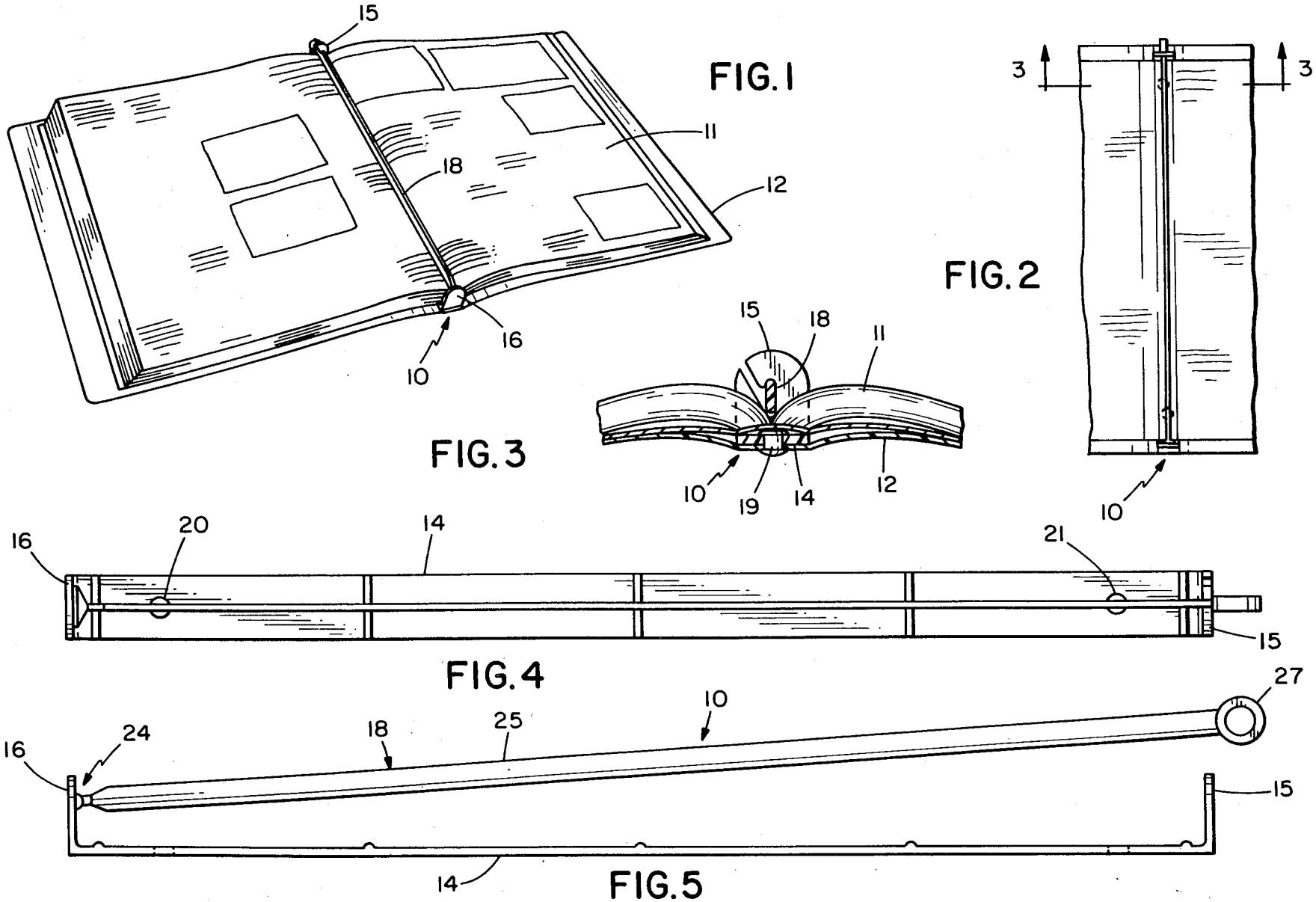
FIG. 1 is a perspective view of a directory with the present binder holding the directory to a protective cover.
FIG. 2 is a fragmentary plan view of the binder illustrated in FIG. 1 with the cover and directory partly broken away.
FIG. 3 is a cross-section taken generally along line 3—3 of FIG. 2 illustrating the locking bracket and location of the blade with respect to the center of the directory.
FIG. 4 is an enlarged top view of the present binder in its as-molded position.
FIG. 5 is a front view of the present binder in its as-molded position.

Viewing FIGS. 1 to 3, the present binder 10 is illustrated in an exemplary application holding a directory such as a telephone directory 11 in a specially designed protective cover 12, which may be constructed of plastic. The cover 12 in addition to its protective function may also in some cases carry advertising and thus may serve as a source of revenue.

The binder 10 generally includes an elongated base 14 having upturned ends 15 and 16 that form brackets for holding an elongated blade 18 in position. The base 14 is permanently attached to a central web on the cover by spaced rivets 19 that pass through pre-formed apertures 20 and 21 (see FIG. 4) in the base 14. The directory 11 is fastened in the binder by opening blade 18 from bracket 15, opening the directory 11 centrally, then inserting the directory between the open blade 18 and the base 14, and then attaching the free end of the blade to bracket 15 which locks the blade in position.

The entire binder 10 according to the present invention is constructed of a one-piece molding of a durable plastic such as polypropylene.

The blade 18 is pivotally connected to bracket 16 by an integral hinge assembly 24 that tends to restrict pivotal motion of the blade 18 to a single plane, and it has a central portion 25 with an elongated cross-section lying in the plane of pivotal movement of the blade, and a integral enlarged annular holding and locking stop 27 at its free end.

The hinge 24 forms an important part of the present invention and is seen more clearly in FIGS. 7, 8, 9 and 10. This hinge 24 tends to restrict pivotal movement of the blade 18 to the plane of the blade and also urges or biases the blade toward its as-molded position illustrated in FIG. 5 in which the blade defines about a 20 degree angle with respect to the base 14. Thus the hinge 24 provides an additional spring biasing function on blade 18.

Hinge 24 includes a rib portion 30 directly connected to bracket 16 and a forwardly tapered flexible portion 31 that has dart-like ribs 32 and 33 along its forwardly converging walls that serve a reinforcing function. Relatively narrow side bar ribs 36 and 37 connect the ends of the reinforcing ribs 32 and 33 with the sides of the blade 18.

Figures 6, 7, 8, 9, 10, 11, 12, 13, 14:
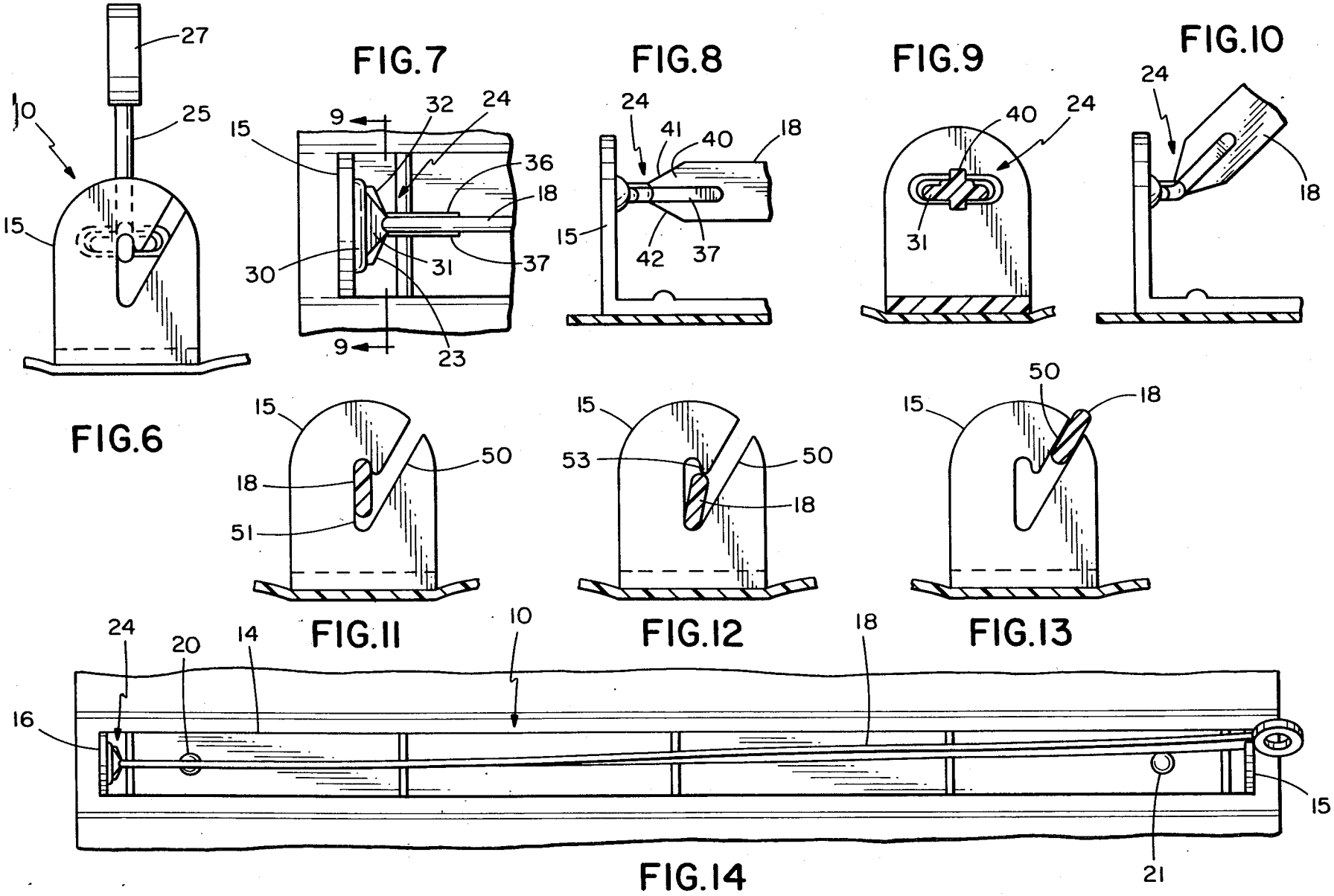
FIG. 6 is a left side view of the binder illustrated in FIGS. 4 and 5, also in its as-molded position.
FIG. 7 is an enlarged fragmentary top view of the blade hinge.
FIG. 8 is an enlarged fragmentary front view of the blade hinge.
FIG. 9 is a cross-section taken generally along line 9—9 of FIG. 7 illustrating the intersecting relationship of the hinge elements.
FIG. 10 is a fragmentary front view of the hinge with the blade moved to its fully open position.
FIGS. 11, 12 and 13 are right-side views of the binder illustrated in FIGS. 4 and 5 with the blade in section illustrating the manner of locking the blade in the locking bracket of the base.
FIG. 14 is a top view of the binder with the blade twisted and entering the entry slot in the locking bracket.

The end of the blade 18 forms part of the hinge and includes a rigid portion 40 (rigid in the plane of pivotal movement of the blade 18) with forwardly converging side walls 41 and 42, that intersects and overlaps the flexible portion 31 of the hinge as seen clearly in FIG. 9. Note that the rigid portion 40 and the flexible portion 31 are orthogonally related, which serves to restrict pivotal motion of the blade 18 to its own plane and also enables the rigid portion 40 to reinforce and strengthen the flexible portion 31 while still providing the necessary pivotal movement.

As seen in FIGS. 11 to 13, the locking bracket 15 has an angularly related entry slot 50, i.e. angularly related with respect to the plane of pivotal movement of the blade 18, and a communicating locking slot 51 that lies in the plane of pivotal movement of the blade 18. The blade 18 is shown in FIG. 11 in the locking slot 18 and it is released from the bracket 18 by pushing downwardly on stop 27 and then twisting the stop 27 slightly as seen in FIG. 12, permitting it to pass by locking finger 53 and align with entry slot 50, allowing the blade to pass through the locking slot and be free from bracket 15. The blade 18 is reinserted into the bracket 15 in the reverse manner.

In FIG. 14 the blade 18 is shown in its twisted position as it enters the entry slot 50 in the locking bracket 15.

We claim:

1. A cover binder for magazines, catalogues and other previously bound sheets, comprising: a one-piece plastic body including a base portion adapted to be fixed to the cover by fasteners, a bracket integral with and extending outwardly from each end of the base portion, a hinge integrally molded with one of the brackets, a binder blade pivotally supported on the one bracket by said hinge, said blade being pivotal in a plane extending through the blade and the base portion, said hinge having a flexible portion extending in a direction transverse to the pivotal plane of the blade to provide increased hinge life, and means on the other bracket for attaching the free end of the blade thereto.

2. A cover binder for magazines, catalogues and other previously bound sheets as defined in claim 1, wherein the hinge has a rigid portion extending in the pivotal plane of the blade that intersects the flexible portion that extends in a plane transverse to the pivotal plane of the blade.

3. A cover binder for magazines, catalogues and other previously bound sheets as defined in claim 1, wherein the blade has an elongated cross-section extending in the pivotal plane of the blade.

4. A cover binder for magazines, catalogues and other previously bound sheets as defined in claim 1, wherein the blade has an enlarged integrally molded loop portion at the free end thereof, said other bracket attaching means for the blade including a first slot extending from the periphery thereof angularly related to the pivotal plane of the blade and a second slot communicating with the first slot and extending in the same direction as the pivotal plane of the blade whereby the blade may be twisted slightly and inserted into the first slot and then returned to its normal position in the second slot whereby the blade is held in position in the other bracket.

5. A cover binder for magazines, catalogues and other previously bound sheets as defined in claim 1, wherein the hinge includes a flat rigid portion with forwardly converging side walls extending in the pivotal plane of the blade, and a substantially flat flexible portion with forwardly converging side walls extending in a plane perpendicular to the pivotal plane of the blade, said flat rigid portion intersecting and overlapping the flat flexible portion with the portions orthogonally related.

6. A cover binder for magazines, catalogues and other previously bound sheets as defined in claim 1, wherein all the edges on the plastic body have smooth radii to minimize scratching.

7. A cover binder for magazines, catalogues and other previously bound sheets, comprising: a one-piece plastic body including a flat elongated base portion adapted to be connected centrally to a cover, integral brackets extending upwardly at each end of the base portion, a flat elongated blade pivotally connected to one of the brackets with an integral hinge, said hinge including a first rigid portion extending in the pivotal plane of the blade and a flexible second portion extending in a plane transverse to the pivotal plane of the blade, said flexible second portion being connected to the one bracket, said first rigid portion overlapping and intersecting the second flexible portion with the first and second portions orthogonally related, said blade having an enlarged portion at the end thereof opposite the hinge, and means on the other bracket for attaching and locking the free end of the blade thereto.

8. A cover binder for magazines, catalogues and other previously bound sheets as defined in claim 7, wherein the blade has an enlarged integrally molded loop portion at the free end thereof, said other bracket attaching means for the blade including a first slot extending from the periphery thereof angularly related to the pivotal plane of the blade and a second slot communicating with the first slot and extending in the same direction as the pivotal plane of the blade whereby the blade may be twisted slightly and inserted into the first slot and then returned to its normal position in the second slot whereby the blade is held in position in the other bracket.

9. A cover binder for magazines, catalogues and other previously bound sheets, comprising: a one-piece plastic body including a flat elongated base portion adapted to be connected centrally to a cover, integral brackets extending upwardly at each end of the base portion, a flat elongated blade pivotally connected to one of the brackets with an integral hinge, said hinge including a flat rigid portion with forwardly converging side walls extending in the pivotal plane of the blade, and a substantially flat flexible portion with forwardly converging side walls extending in a plane perpendicular to the pivotal plane of the blade, said flat rigid portion intersecting and overlapping the flat flexible portion with the portions orthogonally related, and means on the other bracket for attaching and locking the free end of the blade thereto, said other bracket attaching means for the blade including a first slot extending from the periphery thereof angularly related to the pivotal plane of the blade and a second slot communicating with the first slot and extending in the same direction as the pivotal plane of the blade whereby the blade may be twisted slightly and inserted into the first slot and then returned to its normal position in the second slot whereby the blade is held in position in the other bracket, all the edges in the plastic body having smooth radii to minimize scratching.

10. A cover binder for magazines, catalogues and other previously bound sheets as defined in claim 1, wherein the blade has a relaxed position away from the other bracket angularly related to the base portion by about 20 degrees.

11. A cover binder for magazines, catalogues and other previously bound sheets, comprising: a one-piece plastic body including a base portion adapted to be fixed to the cover by fasteners, a bracket integral with and extending outwardly from each end of the base portion, a hinge integrally molded with one of the brackets, a binder blade pivotally supported on the one bracket by said hinge, said blade being pivotal in a plane extending through the blade and the base portion, said blade being molded in a position angularly related to the base so that the hinge tends to continuously urge the blade to that position, and means on the other bracket for attaching the free end of the blade thereto.

* * * * *